US005568710A

United States Patent [19]

Smith et al.

[11] Patent Number: 5,568,710

[45] Date of Patent: Oct. 29, 1996

[54] CONCRETE FORMING SYSTEM WITH EXPANDED METAL TIE

[75] Inventors: Charles S. Smith, Omaha; Jay D. Williamson, Papillion, both of Nebr.

[73] Assignee: I.S.M., Inc., Paola, Kans.

[21] Appl. No.: 269,485

[22] Filed: Jul. 1, 1994

[51] Int. Cl.[6] ..... E04B 2/40

[52] U.S. Cl. ..... 52/426; 52/309.11; 52/309.12; 52/565

[58] Field of Search ..... 52/309.7, 309.11, 52/309.12, 426, 427; 52/562–565

[56] References Cited

U.S. PATENT DOCUMENTS

| | | |
|---|---|---|
| 836,589 | 11/1906 | Layfield et al. . |
| 880,820 | 3/1908 | Pierson . |
| 1,871,318 | 8/1932 | Greenwood . |
| 3,778,020 | 12/1973 | Burrows et al. . |
| 3,788,020 | 1/1974 | Gregori . |
| 3,872,636 | 3/1975 | Nicosia . |
| 3,922,828 | 12/1975 | Patton . |
| 3,979,867 | 9/1976 | Sowinski . |
| 4,223,501 | 9/1980 | DeLozier . |
| 4,516,372 | 5/1985 | Grutsch . |
| 4,698,947 | 10/1987 | McKay . |
| 4,706,429 | 11/1987 | Young . |
| 4,730,422 | 3/1988 | Young . |
| 4,731,968 | 3/1988 | Obino . |
| 4,750,308 | 6/1988 | McKay . |
| 4,765,109 | 8/1988 | Boeshart . |
| 4,879,855 | 11/1989 | Berrenberg . |
| 4,889,310 | 12/1989 | Boeshart . |
| 5,065,561 | 11/1991 | Mason . |

*Primary Examiner*—Carl D. Friedman
*Assistant Examiner*—Beth A. Aubrey
*Attorney, Agent, or Firm*—Chase & Yakimo

[57] ABSTRACT

A form tie made of an expanded metal material extends between the sidewalls of a concrete form. A web traverses the sidewalls and includes, at the opposed ends of the web, first and second parallel flange walls with a supplemental web wall extending therebetween. A return wall extends from the end of the second flange wall. The use of the flange walls, supplemental webs and return walls stiffens the resulting tie so as to preclude sidewall displacement upon a static load thereon. The same elements resist longitudinal and lateral shifting of the tie and attached sidewalls during concrete pouring. The maintenance of the sidewalls by the tie during static and dynamic load conditions allow for easy form connection as well as prevents buckling and/or "blow out" of the forms during concrete pouring.

15 Claims, 6 Drawing Sheets

CONCRETE FORMING SYSTEM WITH EXPANDED METAL TIE

BACKGROUND OF THE INVENTION

This invention relates to concrete forming systems and, more particularly, to an improved tie member for holding and maintaining the sidewalls of a concrete form in their desired relationship while resisting static and hydraulic loads acting thereon.

The use of polymeric foam concrete forms in the construction industry is known. These forms present a pair of sidewalls with vertical and/or horizontal cavities formed therebetween. Upon filling the cavities with concrete and subsequent curing, a concrete wall is presented between the insulating walls. The forms have complementary mating elements for joining the forms in a side-by-side and/or over/under relationship. Examples of such concrete forms are shown in various patents including U.S. Pat. No. 3,788,020 to Gregori.

One problem with use of the forms is the maintenance of the sidewalls of the forms in their original longitudinal and/or lateral relationships. As the poured concrete imparts a dynamic, hydraulic load on the sidewalls, the sidewalls tend to displace which can cause a separation or "blow out" of adjacent forms. Thus, it is desirable to preclude such separation particularly along the horizontal and vertical joints formed between adjacent forms. Tension members as shown in the Gregori U.S. Pat. No. 3,788,020 and the DeLozier U.S. Pat. No. 4,223,501 have been used to preclude such displacement. Basically, these tension members are in the form of a transverse connecting member made of a wire mesh or the like which extends between the sidewalls of each concrete form.

Also during transport the forms are stacked on their sidewalls one atop the other. The weight of the overlying forms may displace the sidewalls of the underlying forms. If so, the forms are difficult to easily connect due to the various distances between the sidewalls of the forms. Thus, preparation time is increased.

The known ties extending between the form sidewalls may not effectively resist static and dynamic loads acting thereon. As the form sidewalls may shift in lateral and/or longitudinal directions during transport and concrete pouring, it is desirable to provide a form tie which precludes such sidewall displacement.

In response thereto we have invented a form tie for use in a concrete forming system generally comprising a transverse web made of an expanded metal or the like. Located at the opposed ends of the web are first flange walls embedded within the form sidewalls. At the free end of each first flange wall is a supplemental web normally extending toward the outside surface of each sidewall. A parallel flange wall then extends from the free end of this supplemental web and towards the major web. An anchor wall at the end of each second flange wall further grips the surrounding foam of the sidewalls. The configuration of the form tie effectively stiffens the entire tie which resists external static and dynamic loads imposed on the form. In turn, the form retains its original shape such that the desired modularity among the forms is maintained. As the allowable load carrying capabilities of each form is increased, greater flexibility of form use results. As such, the height of form courses may be increased before initiating concrete pouring therein.

It is therefore a general object of this invention to provide a form tie for a concrete form which effectively resists static and dynamic loads acting thereon.

Another object of this invention is to provide a form tie, as aforesaid, which is integrated into the form proper during the molding process.

Another object of this invention is to provide a form tie, as aforesaid, which presents structure embedded in the form wall to preclude lateral and longitudinal shifting of the form walls during transport and/or use.

A more particular object of this invention is to provide a form tie, as aforesaid, which effectively grips the surrounding form material.

A still further particular object of this invention is to provide a form tie, as aforesaid, which does not interfere with the flow of concrete between the form sidewalls.

Another particular object of this invention is to provide a form tie, as aforesaid, which is easily formed from expanded metal, fiberglass or other suitable materials.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
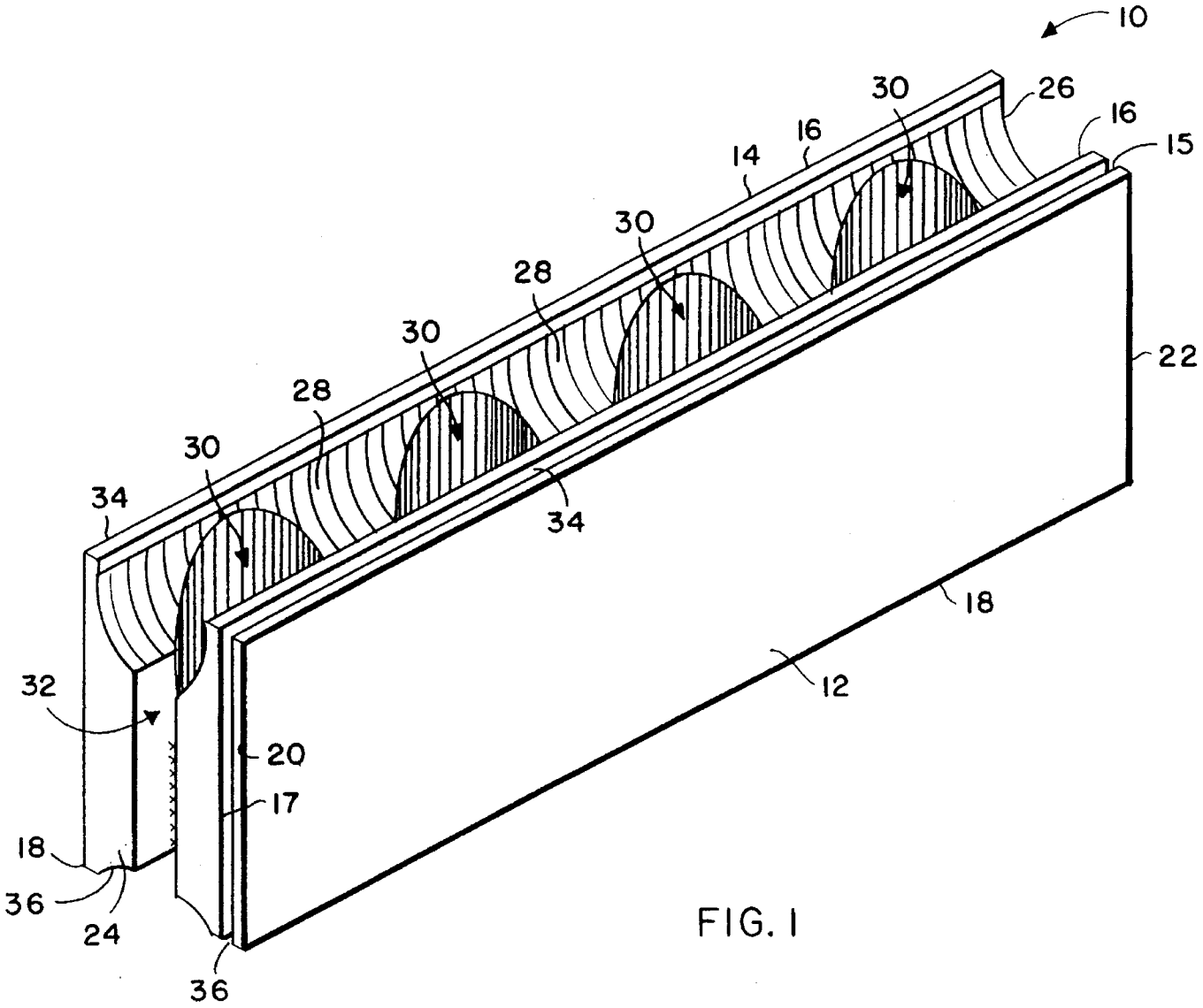
FIG. 1 is a perspective view of one type of concrete form utilizing the expanded metal tie.
Figure 3:
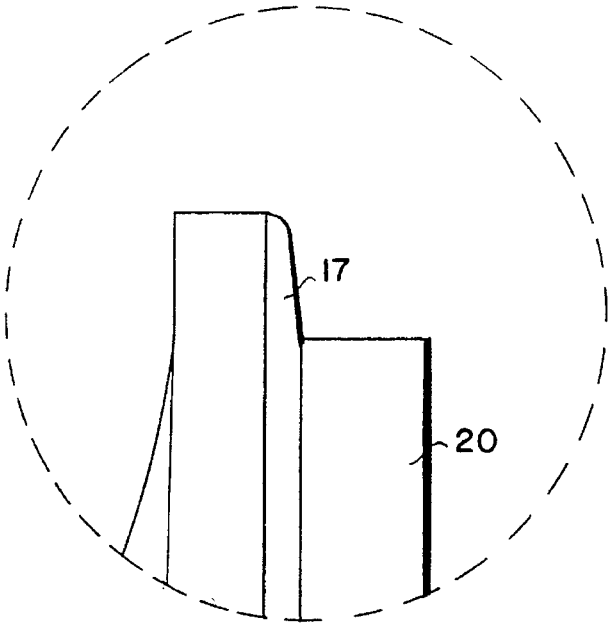
FIG. 3 is an isolated, fragmentary view of a portion of a lap joint surface of the form on a full scale.

Turning more particularly to the drawings, FIG. 1 shows one type of known concrete form 10 as generally comprising a pair of sidewalls 12, 14. Each sidewall has upper 16 and lower 18 longitudinal edges as well as a pair of opposed vertical edges 20, 22. The form 10 further includes a pair of longitudinally displaced end walls 24, 26 with intermediate longitudinally spaced-apart partition walls 28. The sidewalls 12, 14, end walls 24, 26 and partition walls 28 cooperate to form a plurality of vertical cavities 30 and a vertical slot 32 between the facing surfaces of the end walls 24, 26 and partition walls 28. Slot 32 longitudinally spans the length of the form 10 and connects the cavities 30. Each form 10 has complementary tongues 34 along the respective upper 16 edges which mate with complementary grooves 36 located along the lower edges of an overlying form 10.

At one end the end walls 24 extend beyond the sidewalls. At the opposed end the sidewalls 12, 14 extend beyond the end wall 26. Thus, lap joint surfaces are formed. The sidewall extensions 15 at one end of one form overlap the end wall extension 17 of an adjacent form when joined in a longitudinally adjacent relationship. Accordingly, the forms 10 may be connected in longitudinally extending courses and stacked one atop the other with reinforcing bar 600 therein.

Figure 8:
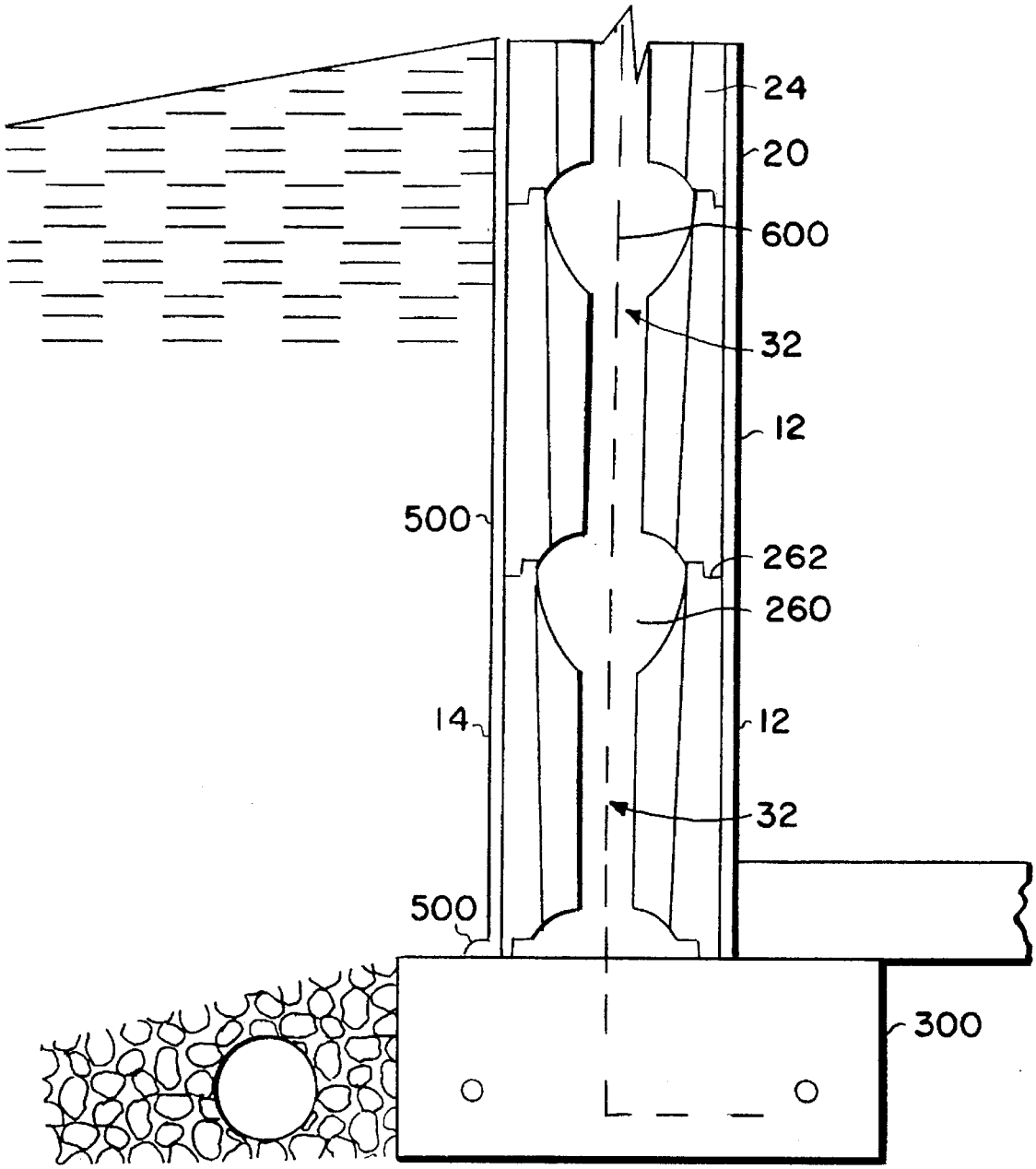
FIG. 8 is a diagrammatic end view of first, second and third courses of the FIG. 1 form atop a supporting footing.
Figure 9:
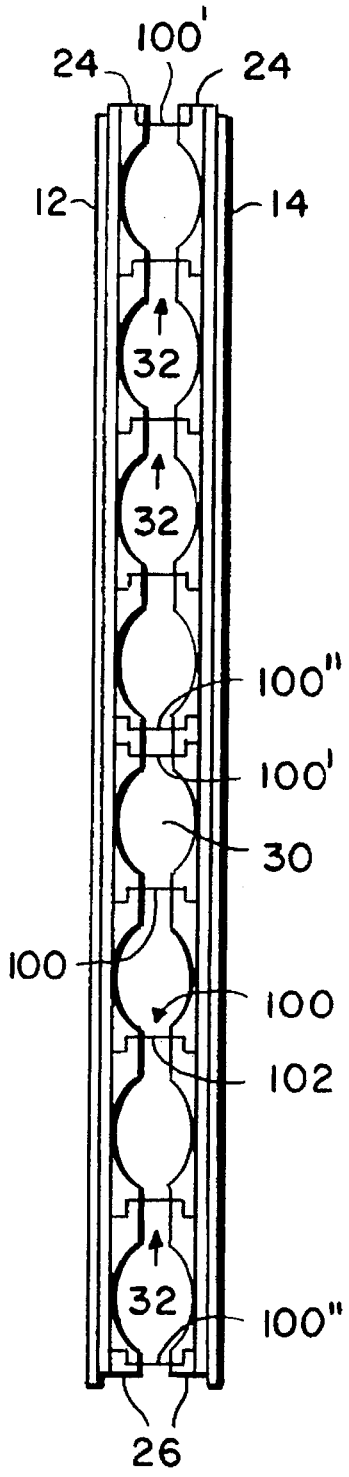
FIG. 9 is a top diagrammatic top view, on a reduced scale, showing first and second forms in a longitudinally adjacent relationship.
Figure 10:
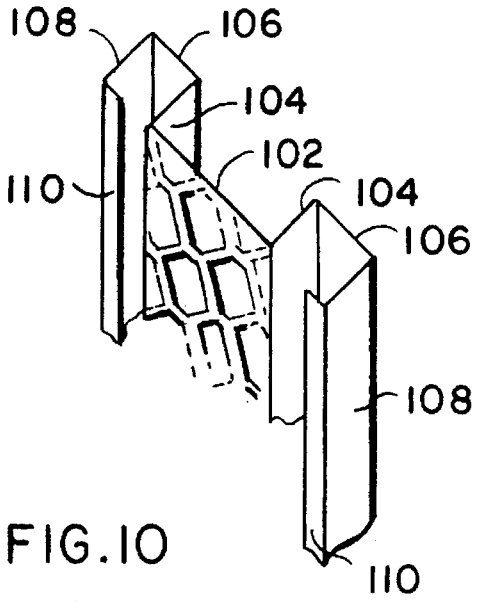
FIG. 10 is a diagrammatic view showing a general configuration of the tie web, walls and flanges.

As shown in FIG. 8 three courses of forms 10 are positioned atop a footing 300 with the first course held in place by plastic roof cement 500. It is understood that other types of connection of the first row of forms to the footing 300 may be utilized such as placing the forms 10 in a wet footing and allowing the footing to subsequently dry. Upon reaching a desired height of the form courses (three as shown) wet concrete is poured between the form sidewalls 12, 14. (It is understood that the forms are staggered among rows so as to preclude formation of a continuous vertical joint among the form rows.) The poured concrete fills the vertical cavities 30 and longitudinally extending vertical slot 32 of each form. Also, upon stacking a second course of forms atop the first a horizontal channel 260 which spans the horizontal joint 262 is formed. The poured concrete will fill the channel 260 of the form. Thus, a concrete wall within slot 32, concrete piers within cavities 32 and a horizontal beam of concrete within channel 260 is presented. The forms 10 are left in place for insulating the resulting concrete wall.

It is known that the courses of the forms may be selectably configured so as to present walls of various configurations. Also, door frames, window frames, bucks, bulkheads, and the like may interrupt the courses of forms so as to provide openings for insertion of doors, windows and the like therein while precluding spillage of poured concrete from the forms.

During the pouring of the concrete a hydraulic concrete load acts on the sidewalls 12, 14 of each form 10 as well as on any structure spanning such sidewalls 12, 14. The load urges the sidewalls 12, 14 from their proper laterally spaced-apart relationship. Also during form transport to the job site, the sidewalls 12, 14 may be displaced due to the weight of other forms stacked thereon. In some cases the distance between the sidewalls 12, 14 may vary. Accordingly, problems will arise when attempting to longitudinally and vertically connect forms as the mating lap joint surfaces and/or tongue/groove elements will not be aligned.

Figure 2:
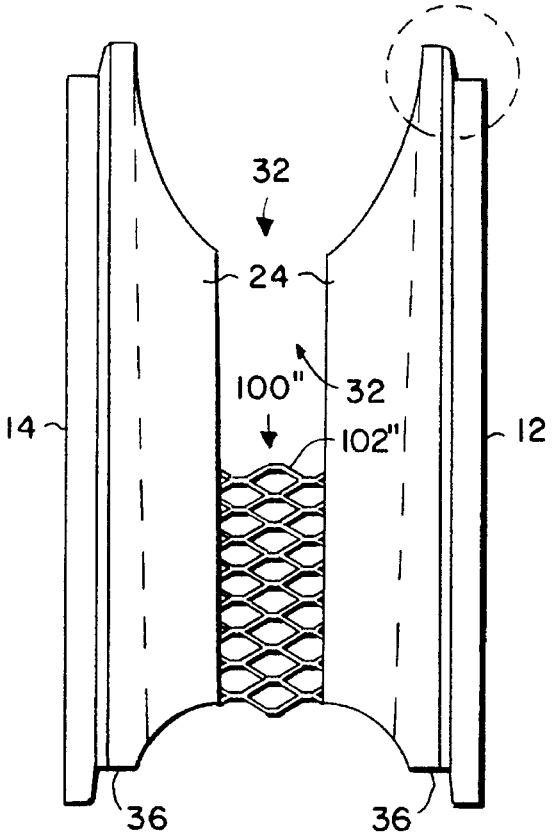
FIG. 2 is an end view of the form of FIG. 1 on an enlarged scale.
Figure 5:
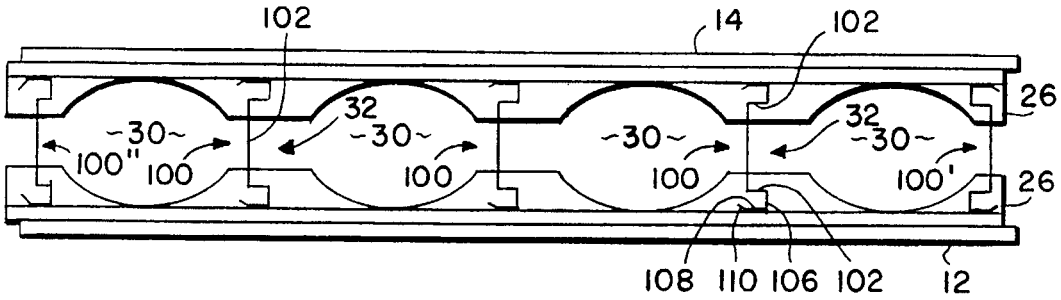
FIG. 5 is a top view of the form of FIG. 4.
Figure 4:
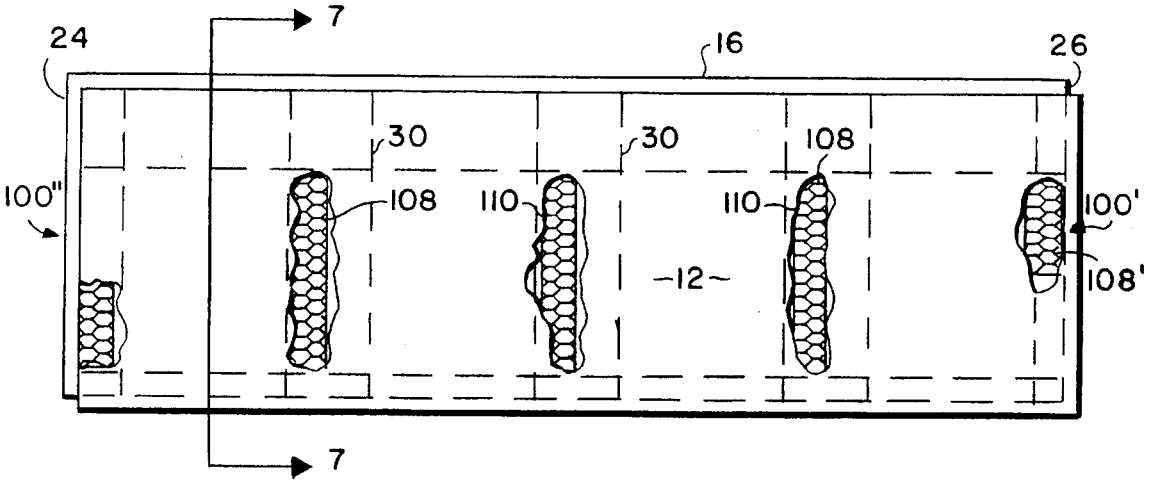
FIG. 4 is a diagrammatic side view of the form, on a reduced scale, with portions of the sidewall broken away to show the adjacent portions of the tie embedded therein.
Figure 6:
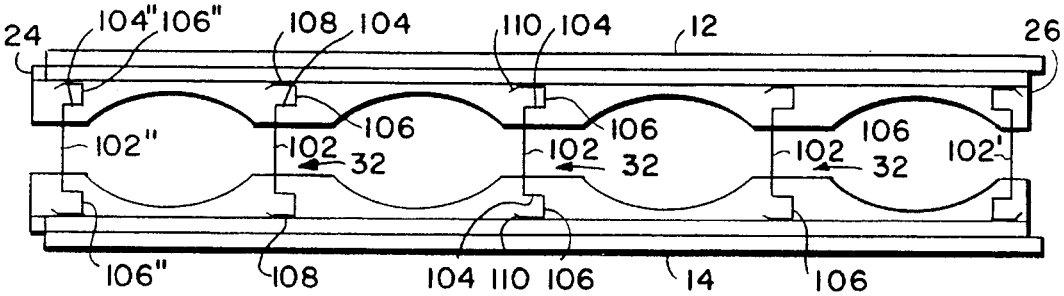
FIG. 6 is a bottom view of the form of FIG. 4.

In response thereto an expanded metal tie 100 as shown in FIGS. 2 et seq., is integrated into the form during the molding thereof. Each tie 100 generally comprises an expanded metal web 102 extending between the partition walls 28 and/or end walls 24, 26 of each form 10 so as to span the vertical slot 32 therebetween. The expanded metal of web 102 preferably presents hexagonal apertures 101 having a major axis 105 normal to the sidewalls 12, 14. Web 102 thus allows for the flow of concrete therethrough while providing transverse support between the sidewalls.

At the opposed ends of the web 102 in each sidewall 12, 14 is a first flange wall 104 of expanded metal generally normal to the web 100 end and longitudinally extending through the foam of the appropriate sidewall 12, 14. The major axes 105 of the hexagonal apertures longitudinally extend along the sidewall so as to provide longitudinal support therein. Normally extending from the end of this first flange 102 and towards the adjacent sidewall 12, 14 is a supplemental web 106 of like expanded metal which is generally parallel to the major web 102. At the end of the web 106 is a second flange wall 108 of expanded metal parallel to the first flange wall 104 and extending toward the major web 102. At the free end of each bridge is a return wall 110 of expanded metal canted away from the flange wall 108 and towards web 102. The height of all walls is generally equal to the web height.

Figure 7:
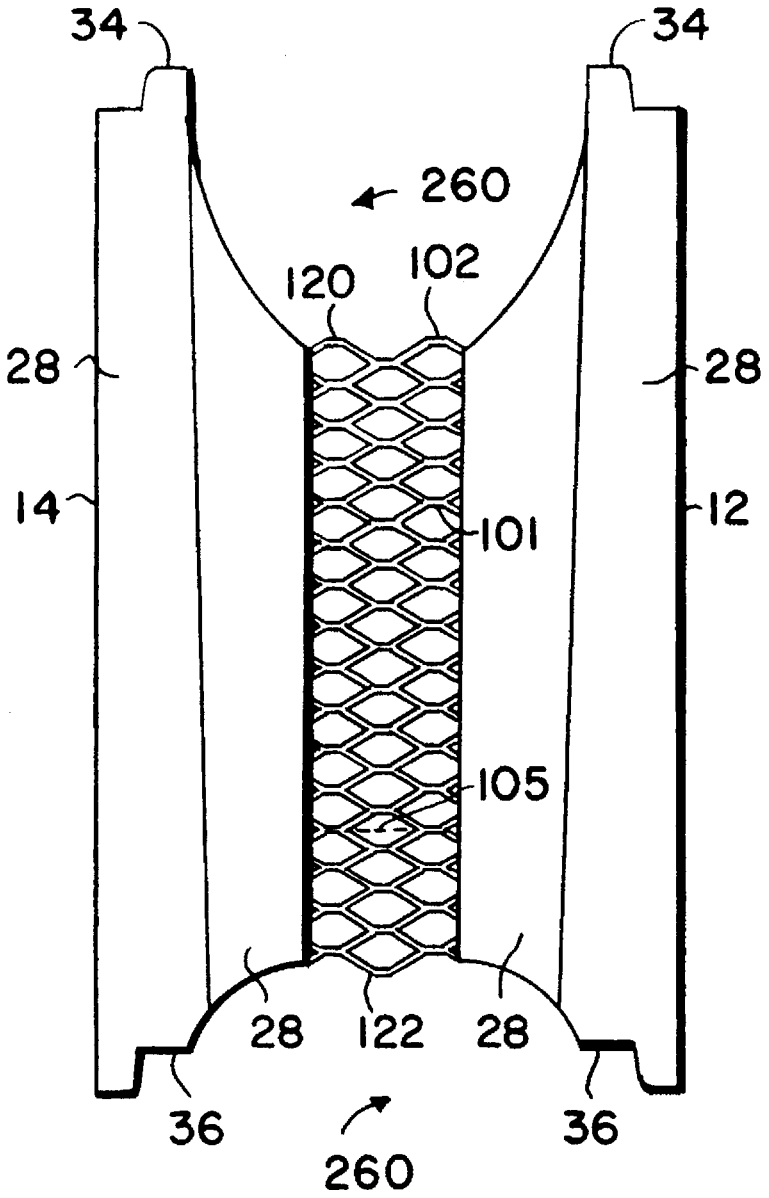
FIG. 7 is a sectional view taken along line 7—7 in FIG. 4 and showing the extension of the web of the form tie between facing partition walls of a form.

As shown in FIG. 7 the web 102 of tie 100 extends along the vertical extent of the partition walls 28. The top 120 and bottom 122 edges of the web 102 are adjacent the channel 260 to preclude interference with the concrete flow through the channel 260. The end tie 100' including web 102', as extended between the sections of end walls 26, extends approximately one-half of the height of the respective end wall from the top thereof. At the opposed end of the form a tie 100" having a height similar to tie 100' but extending from the lower end of end wall 24 may also be used (FIG. 2). This tie height relationship between ties 100', 100" precludes obstruction of concrete flow between the slot 32 which spans the end walls 24, 26 of side-by-side concrete forms 10.

As above discussed the expanded metal ties 100 are placed into the form during molding. The use of the expanded metal material having a plurality of apertures allows the foam to encompass the elements of the ties embedded in the sidewalls 12, 14.

As above stated the pouring of the concrete between the sidewalls 12, 14 of the course of forms 10 produces a hydraulic load on the sidewalls 12, 14 as well as on the web 100. The forces acting on the walls 12, 14 tend to displace the sidewalls 12, 14 from their desired laterally spaced-apart relationship. Such displacement is resisted by the combination of the webs 102, 104, parallel flange walls 102, 108 and anchor wall 110. Furthermore, any longitudinal forces acting on the web 102 or sidewalls 12, 14 are likewise resisted by the elements of tie 100. The relationship of the flanges and webs embedded in the sidewalls 12, 14 are further maintained by the grip produced by the anchor wall 110 of each form tie 100.

As configured, the grip strength of the expanded metal tie 100 is significantly increased relative to prior tension members. Thus, the displacement of the tie 100 from its original position within the form 10 is diminished, if not precluded. In turn, any lateral or longitudinal shifting of the sidewalls 12, 14 is likewise precluded.

Accordingly, the use of the mesh 100 maintains the sidewalls 12, 14 in their desired relationship under both static and dynamic loads, i.e. during both transport and concrete pouring. As the modularity of the forms is maintained the forms 10 are easily connected after transport. A plurality of vertical courses of forms 10 may be efficiently formed with the assurance that the sidewalls 12, 14 will maintain their original longitudinal and lateral relationships during concrete pouring. Thus, the probabilities of wall buckling, shifting and "blow out" caused by hydraulic and/or static forces will likewise be diminished, if not precluded.

Although the above tie 100 has been described with respect to an expanded metal material it is understood that other materials may be used. For example a fiberglass mesh-like material may be utilized having the above described tie 100 configuration. Once positioned in the mold the fiberglass can be sprayed with a liquid plastic which stiffens the fiberglass mesh. The resulting fiberglass tie 100 will have a tensile strength similar to that of a metal tie.

It is to be understood that the dimensions on the drawings are for purposes of illustration and not limitation. Moreover, while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. In a concrete form comprising first and second laterally spaced-apart sidewalls for presenting a cavity therebetween, at least one improved form tie comprising:

a first web extending between the sidewalls with first and second laterally spaced-apart ends embedded in a respective sidewall;

a first flange embedded in each respective sidewall in extension away from each of said first web ends;

a second web in each respective sidewall and extending from each of said first flanges and towards an exterior surface of each respective sidewall;

a second flange in each respective sidewall and extending away from each second web, said form tie resisting forces acting on the form to maintain a desired laterally spaced-apart relationship between the sidewalls.

2. The device as claimed in claim 1 further comprising a plurality of orifices in said first web to allow for passage of a concrete material therethrough.

3. The device as claimed in claim 1 further comprising a return flange at the end of each second flange, said return flange extending away from said adjacent sidewall.

4. The device as claimed in claim 1 wherein said tie comprises an expanded metal material.

5. The device as claimed in claim 1 wherein said tie comprises a stiffened fiberglass material.

6. In a concrete form comprising first and second laterally spaced-apart sidewalls with a pair of end walls and intermediate partition walls extending from each sidewall for presenting a cavity therebetween, at least one improved form tie comprising:

a first web extending between the partition walls with first and second laterally spaced-apart ends embedded in a respective partition wall, said web having a height approximating the vertical extent of said partition wall;

a first flange wall embedded in each respective partition wall in extension away from each of said first web ends;

a second web in each respective partition wall and extending from each of said first flange walls and towards an exterior surface of each respective sidewall;

a second flange wall in each respective partition wall and extending away from each second web, said form tie resisting forces acting on the form to maintain a desired laterally spaced-apart relationship between the sidewalls.

7. The device as claimed in claim 6 further comprising a plurality of orifices in said tie to allow for passage of a surrounding material therethrough.

8. The device as claimed in claim 6 further comprising a return wall at the end of each second flange wall, said return flange wall extending away from said adjacent sidewall.

9. The device as claimed in claim 6 wherein said tie comprises an expanded metal material.

10. The device as claimed in claim 6 wherein at least one tie of said at least one form tie extends between the end walls of the form.

11. The device as claimed in claim 10 wherein a height of said first web of said tie extending between the end walls is approximately one-half the vertical extent of the end walls.

12. The device as claimed in claim 11 wherein said first web of said tie extending between the end walls extends between the upper extent of one of the end walls.

13. The device as claimed in claim 11 wherein said first web of said tie extending between the end walls extends between the lower extent of one of the end walls.

14. The device as claimed in claim 6 wherein said tie comprises a stiffened fiberglass material.

15. In a concrete form comprising first and second laterally spaced-apart sidewalls with a pair of end walls and at least one intermediate partition wall extending from each sidewall for presenting a cavity between the partition wall and the end walls, at least one improved form tie comprising:

a first web extending between the partition walls with first and second laterally spaced-apart ends embedded in a respective partition wall;

a first flange embedded in the partition wall in extension away from at least one end of said web;

a second web in the partition wall and extending from said first flange towards an exterior surface of the sidewall and parallel to said first web;

a second flange extending from said second web and parallel to said first flange, said flanges and webs resisting lateral and longitudinal movement of said first web and the walls connected thereto.

* * * * *